US009101980B2

(12) United States Patent
Dumanski et al.

(10) Patent No.: US 9,101,980 B2
(45) Date of Patent: Aug. 11, 2015

(54) COMPACTING DEVICE

(75) Inventors: Christian Dumanski, Vorchdorf (AT); Robert Spitaler, Bad Wimsbach/Neydharting (AT)

(73) Assignee: Miba Sinter Austria GmbH, Laakirchen (AT)

( * ) Notice: Subject to any disclaimer, the term of this patent is extended or adjusted under 35 U.S.C. 154(b) by 389 days.

(21) Appl. No.: 13/702,631

(22) PCT Filed: Jun. 9, 2011

(86) PCT No.: PCT/AT2011/000260

§ 371 (c)(1),
(2), (4) Date: Jan. 22, 2013

(87) PCT Pub. No.: WO2011/153574

PCT Pub. Date: Dec. 15, 2011

(65) Prior Publication Data

US 2013/0129558 A1 May 23, 2013

(30) Foreign Application Priority Data

Jun. 10, 2010 (AT) ..... A 947/2010

(51) Int. Cl.
*B22F 3/03* (2006.01)
*B22F 3/24* (2006.01)

(52) U.S. Cl.
CPC .... *B22F 3/03* (2013.01); *B22F 3/24* (2013.01)

(58) Field of Classification Search
CPC ..... B22F 3/03; B22F 3/24
USPC ..... 419/28, 66; 425/78; 72/352, 358, 359; 29/893.34
See application file for complete search history.

(56) References Cited

U.S. PATENT DOCUMENTS 3,805,360 A 4/1974 Brede, III et al.
5,325,698 A 7/1994 Nagpal et al.
5,996,229 A * 12/1999 Yang ..... 29/893.34
6,013,225 A * 1/2000 Cadle et al. ..... 419/29

(Continued)

FOREIGN PATENT DOCUMENTS

AT 504 081 3/2008
CN 101569930 A 11/2009

(Continued)

OTHER PUBLICATIONS

International Search Report of PCT/AT2011/000260, date of mailing Oct. 14, 2011.

*Primary Examiner* — Helene Klemanski
(74) *Attorney, Agent, or Firm* — Collard & Roe, P.C.

(57) ABSTRACT

The invention relates to a tool for compacting the surface of a component (2) produced by powder metallurgy, comprising a mold (1) and a stamp (20), wherein in the mold (1) a recess (5) is provided which extends from a first mold opening (6) to a second mold opening (8), and which has a wall surface (10) for supporting the component (2), and the stamp (20) has a stamp length (23) and a stamp surface (21), wherein the inner diameter (12) of the recess (5) of the mold (1) becomes smaller from the first mold opening (6) in the direction of the second mold opening (8) or an external diameter (22) of the stamp (20) becomes greater over the stamp length (23), and wherein a compaction element (17) is arranged on the wall surface (10) of the mold (1) or on the stamp surface (21). The compaction element (17) is configured to have a thread-like progression.

9 Claims, 2 Drawing Sheets

(56) References Cited

U.S. PATENT DOCUMENTS

| | | | | |
|---|---|---|---|---|
| 6,168,754 | B1 | 1/2001 | Woolf et al. | |
| 6,899,846 | B2 * | 5/2005 | Woolf | 419/28 |
| 8,167,602 | B2 | 5/2012 | Hartner | |
| 8,474,295 | B2 * | 7/2013 | Schmid et al. | 29/893.34 |
| 2005/0226759 | A1 | 10/2005 | Trasorras et al. | |
| 2011/0132057 | A1 | 6/2011 | Schmid et al. | |

FOREIGN PATENT DOCUMENTS

| | | |
|---|---|---|
| DE | 2 403 729 | 8/1974 |
| WO | WO 00/48760 | 8/2000 |
| WO | WO 2008/028207 | 3/2008 |

* cited by examiner

COMPACTING DEVICE

CROSS REFERENCE TO RELATED APPLICATIONS

This application is the National Stage of PCT/AT2011/000260 filed on Jun. 9, 2011, which claims priority under 35 U.S.C. §119 of Austrian Application No. A 947/2010 filed on Jun. 10, 2010, the disclosure of which is incorporated by reference. The international application under POT article 21(2) was not published in English.

The invention relates to a tool for compacting the surface of a powder-metallurgically produced component, comprising a mold and a stamp, wherein in the mold there is recess, which extends from a first mold opening to a second mold opening, and which has a wall surface for supporting the component, and the stamp has a stamp length and a stamp surface, wherein an inner diameter of the recess of the mold becomes smaller from the first mold opening to the second mold opening or an external diameter of the stamp becomes greater over the stamp length, and wherein on the wall surface of the mold or on the stamp surface a compaction element is arranged, a method for compacting the surface of a powder-metallurgically produced component, with a tool which comprises a mold and a stamp, wherein the component is moved by the mold or the stamp through a recess of the component and is surface-compacted thereby, as well as a powder-metallurgically produced component with a component body which has at least one compacted side surface or at least one recess with at least one compacted wall surface.

For a long time sintered parts, i.e. workpieces made of pressed and sintered metal powder, have been an alternative to cast workpieces or completely processed workpieces. However, the more or less manifest porosity of the sintered parts, which is determined by the production process, has a negative effect on the bending resistance and the wearing resistance, which for example restricts the use of gear wheels produced by powder metallurgy in highly stressed gears.

In order to reduce the disadvantageous effects of the porosity of sintered parts it is known to compact the surface of sintered blanks by pressing subsequently. A method which also uses a mold tool is known from U.S. Pat. No. 6,168,754 B1. In this method a sintered blank, i.e. a pressed part made of powdered metal and then sintered is compacted on its outer surface, in that the latter is pressed by a multistage mold tool. The mold tool comprises a plurality of axially spaced apart mold plates with mold openings, which essentially correspond to the form of the sintered blank, the inner diameter of which decreases in stages and is smaller than the external diameter of the sintered blank. During this pressing through from the largest to the smallest mold opening the external periphery of the sintered part is deformed plastically and elastically, whereby the surface is compacted and the sintered part obtains its final dimensions. The distances between the mold plates make it possible for the sintered part by stretching to remove a portion of the elastic deformations after each mold plate. By means of this sequence of mold plates and intermediate spaces the sintered part experiences an intermediate relief of pressure after each mold plate, whereby residual internal stress in the sintered part after shaping is reduced gradually.

Said internal stresses increase the bending resistance in tension loaded areas and improve simultaneously the wearing resistance of the surface compacted in this way. A disadvantage of the method or mold tool described in US-B1 is however that the mold tool owing to the intermediate spaces formed between the individual mold plates has a lower stability and wearing resistance, whereby the shaping forces that can be born by the mold tool are clearly limited and the achievable surface compaction is still insufficient for certain applications.

To avoid this disadvantage in WO 2008/028207 A2 of the present applicant a method is known for the surface compaction of a sintered part, in which a sintered part is moved in a mold tool along an axis in a pressing direction through a plurality of mold sections from one first mold section on a first mold opening into a last mold section, wherein a wall surface of each mold section forms at least one pressing surface, against which a contact surface formed by an outer surface of the sintered part is pressed, and an inner contour defined by the pressing surface and lying in a cross section relative to the axis corresponds at least almost to an outer contour defined by the contact surface. During the movement of the sintered part the surface compaction is performed from the first mold opening into the last mold section by mold sections passing into one another continuously and inner diameters of the mold sections measured between interacting pressing surfaces which decrease repeatedly. Furthermore, said WO-A2 describes a tool for performing said method.

The problem addressed by the present invention is to provide a better way of compacting the surface of a component produced by powder metallurgy.

This problem is solved independently by the aforementioned tool, the aforementioned method for compacting the surface of a component produced by powder metallurgy and by the component itself, wherein the compaction element of the tool is configured to have a thread-like form, in which method the compaction of the surface is performed in a tool according to the invention, whereby the component is moved in a linear movement along an axis through the mold or the stamp in a linear movement through the recess in the component past the thread-like compaction element(s) of the tool and the component itself thereby has a side surface or a wall surface with a wave-like surface topography.

It is an advantage here that by means of the thread-like design of the compaction element relatively small compaction stages are achieved, whereby a material-protecting shaping is achieved, which is supported by the component hitting the component on the oblique shaping edge of the compaction element. The tool itself still has a relatively simple structure. In particular, the mold can made in one piece like the stamp. By means of the thread-like compaction element however also the relaxation of the compacted component areas is possible outside the compaction areas, whereby the formation of a ridge on the component can be reduced significantly by the compaction. The formation of the ridge can however also be reduced by the force components acting in the circumferential direction of the component. Surprisingly, it was established that the components compacted according to the method or by the tool also reduce the level of noise produced during the application of the components, which is presumably caused by the special surface topography created during and by the compaction. A further advantage is that in the free spaces between the compaction areas forming oil can be stored i.e. in the relaxation areas, whereby it is easier to prevent the tearing of the lubricant film during the shaping. In this way the stress on the tool and the oil consumption can be reduced. As a result the tool also has a longer lifetime.

Preferably, a plurality of spiral-shaped compaction elements are arranged distributed over the respective surfaces. In this way not only is a better or greater compaction of the component achieved, but in this way mainly for the component in the tool a multi-point support is provided so that the tilting of the component can be better avoided during the compaction. In particular it is an advantage if the plurality of compaction elements are offset relative to one another by an equal angle, whereby said effects are increased.

To improve the compaction further it is possible for the thread-like compaction element or elements to have a pitch which varies over the length of the compaction element or elements. In this way over the length of the compaction path of the tool areas are created which have a different compaction effect on the component surface, i.e. areas with a greater compaction effect and areas which can have a greater relaxation effect on the component.

The compaction element or elements can have a bevelled edge or a rounded edge, in order in this way on the one hand to avoid greater wear on the tool at least as far as possible and on the other hand to enable a more "gentle" transition of the component from the compaction areas to the relaxation areas and vice versa, without a sharp-edged step causing an unintentional removal of material from the component or the edges of the transition points of the tool breaking loose.

The inner diameter of the recess in the mold can decrease linearly or the external diameter of the stamp can increase linearly in pressing direction. In this way the production of the tool is simplified. In addition, in this way also fluctuating rough diameters of sintered components possibly caused by the production process can be better adjusted.

In order to allow a better adjustment of the tool to different sintered alloys—it has been shown in practice that sintered components depending on the composition also allow different degrees of shaping in a compaction stage and it is better if the consecutive compaction stages are performed in the tool with different shaping gradients, the inner diameter of the recess can decrease in the mold progressively or degressively or the external diameter of the stamp can increase in pressing direction progressively or degressively.

The end section of the recess in the mold or the stamp can be configured to be cylindrical, whereby said end section can also be free of compaction elements in order to adjust the component in this way.

For a better understanding of the invention the latter is explained in more detail with reference to the following Figures.

In a schematically simplified representation:

Figure 1:
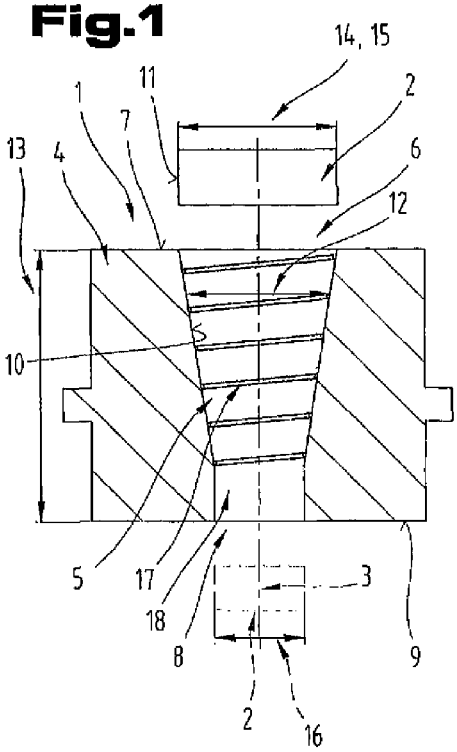
FIG. 1 shows a mold in side view in cross sectional plan view.

First of all, it should be noted that in the variously described exemplary embodiments the same parts have been given the same reference numerals and the same component names, whereby the disclosures contained throughout the entire description can be applied to the same parts with the same reference numerals and same component names. Also details relating to position used in the description, such as e.g. top, bottom, side etc. relate to the currently described and represented figure and in case of a change in position should be adjusted to the new position. Furthermore, also individual features or combinations of features from the various exemplary embodiments shown and described can represent in themselves independent or inventive solutions.

Figure 2:
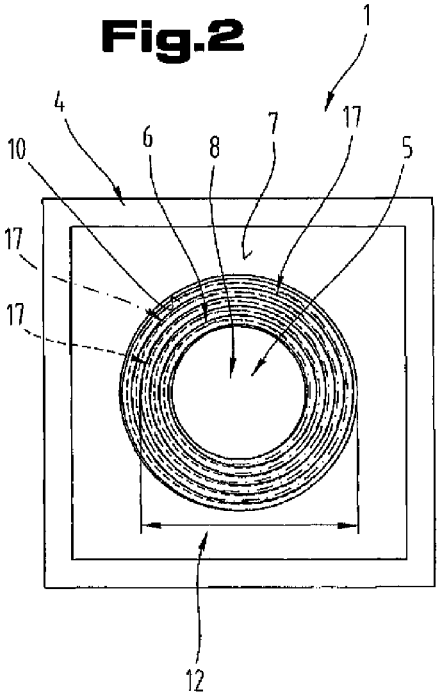
FIG. 2 shows the mold according to FIG. 1 in plan view.

FIGS. 1 and 2 show a longitudinal cross section and a plan view of a mold 1 for a tool for compacting the surface of a component 2 by moving the latter along an axis 3 through the mold 1. The latter comprises a mold basic body 4, which has a recess 5, which extends from a first mold opening 6 on a first mold surface 7 up to a second mold opening 8 opposite the first mold opening along the axis 3 on a second mold surface 9 continuously through the mold body 4 and the cross section of which is adjusted to the cross section of the component 2 to be compacted. The recess 5 has a wall surface 10 for supporting a component surface 11 of the component 2. Furthermore, the recess has an inner diameter 12, which decreases beginning at the first mold opening 6 in the direction of the second mold opening 8, whereby the recess 5 tapers over at least a portion of a pressing length 13 of the mold 1 along the axis 3.

The component 2 is made of pressed and subsequently sintered metal powder, i.e. is produced by powder metallurgy, whereby the method and materials for producing such a sintered blank are sufficiently well known from the prior art and therefore need not be explained in more detail.

The component 2 is configured to be disc-like in the exemplary embodiment shown and on the component surface 11 has a diameter 14 which prior to the surface compaction corresponds to a rough diameter 15 and after the surface compaction to a smaller final diameter 16.

On the wall surface 10 and projecting over the latter at least one compaction element 17 is arranged. The compaction element 17 has a thread-like form, and extends from the area of the first mold opening 6 up to the area of the second mold opening 8 in the form of a helical line or spiral-like, and can therefore be denoted as a forming spiral. Thus by means of the compaction element 17 an oblique forming edge can be compacted. By means of the pitch of the compaction element 17, i.e. the forming spiral there is a "wandering forming point" or a "wandering forming edge" along the component periphery.

The term "from the area" and "up to the area" is used to mean that it is possible within the scope of the invention that the compaction element 17 need not necessarily be arranged on the first mold opening 6, but a run-in area can be formed in the mold 1 on the first mold opening, in which no compaction element 17 is arranged in order to facilitate the insertion of the component 2 into the mold. On the other hand an end section 18 of the recess 5 of the mold 1 can also be free of the compaction element 17 or compaction elements 17. For example said end section can have an inner cross section which corresponds to the outer contour of the finally compacted component 2, i.e. for example a cylindrical cross section in order in this way in a final stage of the compaction of the surface of the component 2 to enable the adjustment of the latter. Of course, it is also possible that the compaction element 17 on the wall surface 10 extends from the first mold surface 7 to the second mold surface 9.

The compaction element 17 preferably extends continuously without interruption in the recess 5, whereby it is possible however for said compaction element 17 to be divided into individual, slightly spaced apart compaction element sections.

As shown in FIG. 2 by a dashed line and dash-dotted view, it is possible within the scope of the invention, that a plurality of compaction elements 12 are arranged on the wall surface 10, i.e. for example two, preferably three (as represented), or four, five, six, etc. The compaction elements 17 are preferably in the form of a multiple-pitched thread, i.e. for example a triple-pitched thread, whereby the resulting "compaction threads" are arranged offset relative to one another in particular by an equal angular distance, which is provided by dividing 360° by the number of thread-like compaction elements 17, i.e. for example 120° in an arrangement of three compaction elements 17.

Preferably, the compaction element or elements 17 is or are worked out of the wall surface 10 of the recess 5, i.e. are formed in one piece with the mold 1.

The surface compaction of the component 2 is performed in that the latter is inserted through the first mold opening 6 into the recess 5 and is then moved up and through the second mold opening 8, whereby the component surface 11 of the component 2 is pressed against the compaction element or elements 17 of the mold 1. Alternatively, the direction of the movement of the component 2 can also be reversed so that the component 2 is not removed via the second mold opening 8 but the first mold opening 6 is removed from the mold 1.

The pressing effect is achieved in that the inner diameter 12, which is defined by the internal width between opposite or cooperating sections of the wall surface 10 of the recess 5, wherein the compaction element or elements 17 is or are to be seen as part of the wall surface 10, is smaller respectively than the rough diameter 14 of the component 2. The term inner diameter 12 is not limited to circular cross sections, but also defines the internal width between interacting pressing surface parts, which need not necessarily go through the axis 3 of the mold 1. Thus also cross sections of the component 2 can be compacted that are not circular. Likewise the diameter 14 on the component 2 is not restricted in its definition to radial directions. In the area of the insertion of the component 2 into the recess, the recess 5 preferably has an inner diameter 14, which is at least not smaller than the rough diameter 15 of the component, in order to simplify the insertion of the component 2 in this way.

The movement of the sintered part 2 in the mold tool 1 is preferably performed in a straight line along the axis 3 in a pressing direction from the first mold opening 6 up to the second mold opening 8, afterwards the component 2 is removed from the mold 1, via the second mold opening 8 or after a reversal of the direction of movement opposite the pressing direction through the first mold opening 6, whereby an ejector element can be arranged in the second mold opening.

The straight movement in the direction of the axis 3 can also be overlayered by a rotary movement, whereby the component 2 in the mold 1 performs a helical movement. By way of this type of movement with the mold 1 also components 2 can be compacted on their surface, the component surface 11 of which also comprises helical surfaces. The movement of the component 2 is performed in this case around a helical axis, which coincides with the axis 3 or is parallel thereto, for example when the helical surface to be compacted on the component surface 11 is not arranged on the entire circumference of the component 2 and the latter does not have a rotationally symmetrical basic body. In the case of overlayering the straight movement however the pitch of the helical movement needs to be taken into consideration, which has to be different from the pitch of the thread-like compaction element 17 in order to achieve surface compaction, i.e. to prevent the component 2 sliding in the compaction path of the compaction element 17.

The movement of the component 2 in the mold 1, as with the movement speed for optimizing surface compaction, can be in any direction, and e.g. can also comprise a reversal of movement direction, stop of movement, very slow or also very fast movements. It is possible in this way that the compaction is performed with at least two movement reversals of the component 2 relative to the mold 1, i.e. the component 2 is moved for example downwards through the mold 1, in the mold 1 the component is moved back a short amount opposite the direction of movement and then is moved within the mold 1 after a repeat reversal in movement back into the original direction through the mold 1. Of course, this process can be repeated several times or the mold 1 can be moved instead of and/or in addition to the component 2. By means of the pressing effective between the compaction element 17 and the component surface 11 pressure tensions are created, by means of the movement of the component 2 the component surface 11 also experiences a sliding frictional tension in axial direction in a straight movement or in both axial and tangential direction in a helical movement. Said tensions acting on the component surface 11 in the component 2 cause both an elastic and a plastic deformation of the component 2, wherein the plastic portion causes the permanent surface compaction. With this surface compaction the powder metal particles joined together by the pressing and subsequent sintering on so-called bridges are pressed strongly against one another and deformed plastically. The porous cavities between the powder metal particles after the sintering are thereby reduced in volume and the material density in this area is increased.

The explanations regarding the movement sequence also apply to the stamp.

The effect of the surface compaction is greatest by means of the additional sliding friction tensions directly on the component surface 11 and decreases in the direction of the inside of the component 2. By means of the method typically edge layers of components 2 with a thickness of several hundredths of a millimeter can be compacted to up to several tenths of millimeters and more. After this surface compaction residual compressive stresses remain in the component 2 in its edge layers which provide an advantageous increase in the bending resistance and an increase in the wearing resistance.

As the component 2 along its path through the mold in the pressing direction after sliding over the compaction element or elements 17 repeatedly contacts areas of the recess 5, which owing to the "threaded pitches" of the compaction element or elements 17 have larger inner diameter 12—compared to the compaction element or elements 17—a partial relaxation is also possible for the component 2, whereby the material of the component 2 springs back. In this way a component and tool-protecting type of compaction is possible, as by means of the repeated compaction and relaxation smaller shaping forces are necessary. In addition, by means of the thread-like compaction element 17 the working step "compaction" is limited to a small surface area or a point shaping, whereby also the necessary forming forces can also be reduced. By means of the "offset" of the compaction element or elements 17 on the diameter 14 of the component 2 during the entire compaction process at least one area is always in the working step "compaction" or "relaxation". In this way components 2 can be produced which in the region of the component surface 11 have at least almost full density. In the core of the component 2, i.e. in the basic structure of the component 2, there can be a sharper, i.e. more sudden, transition between the at least almost full density surface area and the basic structure.

The relative movement necessary for performing the method between the component 2 and the mold 1 can be performed by moving the component 2 and/or by moving the mold 1, wherein the component 2 and the mold 1 can be connected with a suitable drive or fixed frame or the component 2 is moved by means of a stamp or an upper stamp and a lower stamp through the mold 1, as already known.

As already mentioned it is possible that the compaction element 17 is not designed to run over the entire inner periphery of the recess 5, but that a predefinable part of the wall surface 10 of the recess 5 in the direction of the axis 3 is free of compaction elements 17. It is thus possible to produce components 2, as the movement of the component 2 is performed during the compaction preferably in the direction of the axis, which are only surface compacted in one part area. However, it is also possible to produce components 2 which have a different degree of surface compaction in different areas, in that the compaction element 17 is configured to extend continuously only over a part of the pressing length 13 of the mold 1 over the periphery of the recess 5 or at least one further thread-like compaction element 17 is arranged only in a part area of the periphery of the recess 5 over the pressing length 13. Furthermore, it is possible that with a plurality of compaction elements 17 the latter have a different total length.

A compaction element 17 can have a pitch which is selected from a range of 0.5 mm to 150 mm, in particular is selected from a range of 5 mm to 100 mm or is selected from a range of 20 mm to 50 mm. It is also possible in this case that in an arrangement of a plurality of compaction elements 17 at least two have a pitch angle which is different from the other at least over a portion of the total length of a compaction element 17. In addition, a compaction element 17 can be configured over its entire length to have at least two different pitch angles, for example the pitch angle in the area of the first mold opening 6 can be greater than in the area of the second mold opening 8, so that in other words the "thread pitch" or "compaction pitch" becomes tighter over the length of the compaction element 17. Such a configuration of a compaction elements 17 can also be used in an arrangement with several compaction elements 17.

The compaction element or elements 17 can be configured in the form of a "left-hand thread" or a "right-hand thread".

Figure 3:
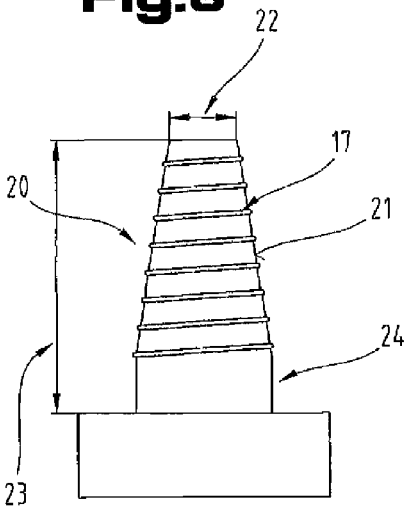
FIG. 3 shows a stamp in side view.

FIG. 3 shows a stamp 20 for compacting the surface of a recess in a component 2 (not shown), for example a gearwheel. In addition the stamp 20 comprises on an outer stamp surface 21 projecting over it at least one of the aforementioned thread-like compaction elements 17, whereby with respect to the explanations on the compaction element or elements 17 reference is made to the above explanations to avoid repetition.

To enable the step-by-step compaction of the surface an external diameter 22 increases along a stamp length 23, i.e. a length of the mandrel entering into the recess of the component during the compaction, as can be taken from FIG. 3. An end section 24 of this mandrel can be configured without compaction elements 17, in order to achieve the adjustment of the surface-compacted component 2. Said end section also preferably has a cross section which corresponds to the cross section of the finally compacted component 2, for example is configured to be cylindrical.

It is possible both for the mold 1 and also the stamp 20 that one end section is larger or smaller with respect to its internal width or external diameter 22 than the corresponding dimension in the finished component 2, and by the amount of the elastic (back)spring of the component 2 after the compaction stage. It is thus possible by means of the mold 1 or the stamp 20 to provide a support function during the (back) springing.

It is also possible within the scope of the invention that for the surface compaction of a component 2 the mold 1 according to the invention is used in combination with the stamp 20 according to the invention, in order to achieve the compaction both of the inner component surface and also the outer component surface 11 in one working step.

Figure 4:
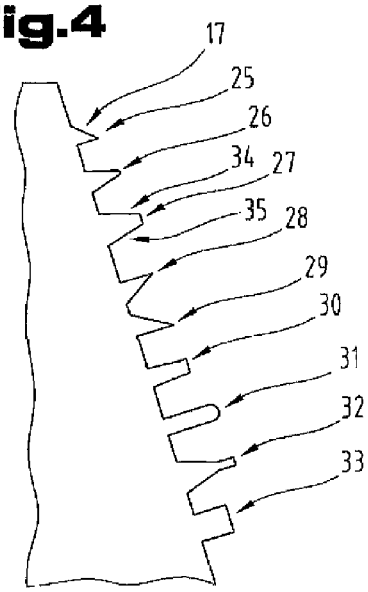
FIG. 4 shows different profile cross sections of compaction elements.

The compaction element or elements 17, as shown in FIG. 4 with reference to examples, can have different profile cross sections 25 to 33, for example a pointed profile such as e.g. a pointed profile cross section 25, a rounded profile cross section 26, a conically overwound profile cross section 27, a saw profile, such as e.g. a pole-sided flat profile cross section 28 or an equator-side flat profile cross section 29, a flat profile, such as e.g. a conically flattened profile cross section 30 or a rounded profile cross section 31, a profile cross section 32 combined in particular from said profile cross sections 25 to 31, or a round profile cross section 33. The compaction element or elements 17 can however also be provided with beveled edge.

Furthermore, a side 34 facing the component 2, when the latter is moved towards the compaction element 17, can enclose a different angle with the wall surface 10, than a side 35 facing away from the component in the direction of movement. For example, the facing side 34 can be steeper than the averted side 35, in order to simplify the "driving over" of the compaction element 17 with the component 2 and thereby enable a more tool-protecting compaction.

It is also possible however for the profile cross section of the compaction element 17 to change over its full length, e.g. in the area of the first mold opening 6 there are steeper profile cross sections which are inclined relative to the wall surface 10 at a lower angle of inclination of the sides 34, 35 against the wall surface 10, i.e. in areas with even lower surface compaction of the component 2, and in the area of the second mold opening 8 flatter profile cross sections are inclined relative to the wall surface 10, i.e. at a greater angle of inclination of the sides 34, 35.

Figure 5:
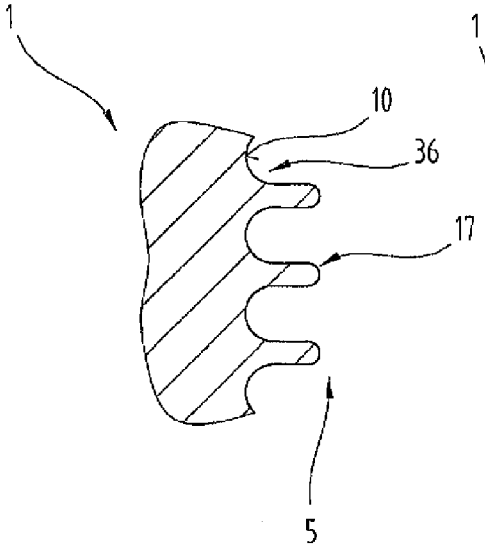
FIG. 5 shows a cut-out of an embodiment variant of the mold in side view in cross section.
Figure 6:
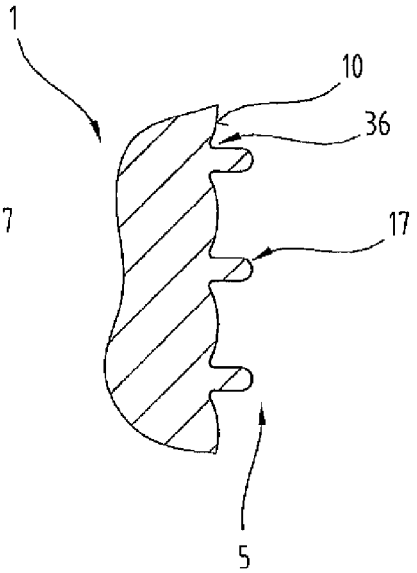
FIG. 6 shows a cut-out of a further embodiment variant of the mold in side view in cross section.

A transitional area 36 between the wall surface 10 of the recess 5 of the mold 1 or the stamp surface 21 of the stamp 20 and the compact element or elements 17 can be designed to be rounded, as shown in FIGS. 5 and 6, which show cut-outs of embodiment variants of the mold 1 in cross section.

The cross section of the recess 5 tapers in the simplest case conically from the first mold opening 6 in the direction of the second mold opening 8. However, it is also possible, as shown in FIGS. 5 and 6, for the wall surface 10 of the recess 5 of the mold 1 to have a convex or concave curvature between the projections formed by a compaction element 17, wherein also mixed forms with convex curved areas and concave curved areas are possible in a recess 5. In addition to the conical tapering it is also possible that the inner diameter 12 (FIG. 2) of the recess decreases progressively or depressively or a combination thereof. Of course, the explanations in this paragraph also apply to the stamp 20, i.e. the stamp surface 21.

Figure 7:
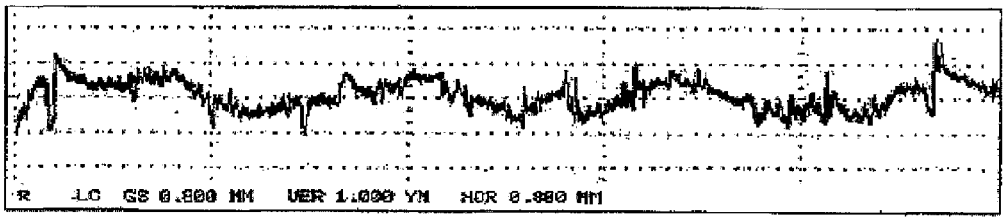
FIG. 7 shows a diagram of the surface roughness of a sintered component compacted by the tool according to the invention.

As already mentioned above by means of the use of the mold 1 and/or the stamp 20 for surface compaction a component 1 is produced the outer component surface 11 of which and/or inner surface of a recess has a wave-like form at least in some parts. FIG. 7 shows an example of the progression of the surface roughness on a finally compacted component 2 (FIG. 1). The y-axis shows the surface roughness in μm and the x-axis shows the component height (in the pressing direction, as shown in FIG. 1) in μm.

The exemplary embodiments show possible embodiment variants of the mold 1, the stamp 20 and the component 2, whereby it should be noted at this point that the invention is not restricted to the embodiment variants shown in particular, but rather various different combinations of the individual embodiment variants are also possible and this variability, due to the teaching on technical procedure, lies within the ability of a person skilled in the art in this technical field.

Finally, as a point of formality, it should be noted that for a better understanding of the structure of the mold 1, the stamp

20 and the component 2, the latter or their components have been represented partly untrue to scale and/or enlarged and/or reduced in size.

LIST OF REFERENCE NUMBERS

1 Mold
2 Component
3 Axis
4 Mold basic body
5 Recess
6 Mold opening
7 Mold surface
8 Mold opening
9 Mold surface
10 Wall surface
11 Component surface
12 Inner diameter
13 Pressing length
14 Diameter
15 Rough diameter
16 Final diameter
17 Compaction element
18 End section
20 Stamp
21 Stamp surface
22 External diameter
23 Stamp length
24 End section
25 Profile cross section
26 Profile cross section
27 Profile cross section
28 Profile cross section
29 Profile cross section
30 Profile cross section
31 Profile cross section
32 Profile cross section
33 Profile cross section
34 Side
35 Side
36 Transitional area

The invention claimed is:

1. A kit for compacting a surface of a powder-metallurgically produced component, the kit comprising a mold and a stamp, wherein in the mold a recess is arranged which extends from a first mold opening to a second mold opening (8), wherein the mold has a wall surface for supporting the component, and wherein the stamp has a stamp length and a stamp surface, wherein an inner diameter of the recess of the mold decreases from the first mold opening in the direction of the second mold opening or an external diameter of the stamp increases along the stamp length, wherein on the wall surface of the mold or on the stamp surface a compaction element is arranged, and wherein the compaction element is configured to have a thread-like progression as a forming spiral with an oblique shaping edge for compaction.

2. The kit as claimed in claim 1, wherein a plurality of thread-like compaction elements are provided in the form of a multi-pitched thread.

3. The kit as claimed in claim 2, wherein the plurality of compaction elements of the multi-pitched thread are offset respectively relative to one another by an equal angle.

4. The kit as claimed in claim 1, wherein the thread-like compaction element comprises a thread pitch which changes over the length of the compaction element or elements.

5. The kit as claimed in claim 1, wherein the compaction element has a beveled edge or a rounded edge.

6. The kit as claimed in claim 1, wherein the inner diameter of the recess in the mold decreases linearly or the external diameter of the stamp increases linearly in a pressing direction.

7. The kit as claimed in claim 1, wherein the inner diameter of the recess in the mold decreases progressively or degressively or the external diameter of the stamp increases progressively or degressively in a pressing direction.

8. The kit as claimed in claim 1, wherein an end section of the recess in the mold or the stamp is configured to be cylindrical.

9. A method for compacting a surface of a powder metallurgically produced component using a kit as claimed in claim 1, the method comprising a step of:

moving the component through the mold in a linear movement along an axis and past the compaction element or moving the stamp through a recess of the component in a linear movement and past the compaction element, and in this way compacting the surface of the component.

* * * * *